United States Patent [19]

Anstey et al.

[11] Patent Number: 4,471,631

[45] Date of Patent: Sep. 18, 1984

[54] MOBILE WATER CHILLER APPARATUS

[75] Inventors: Leslie M. Anstey, Alexandria; Ralph J. Adolph, Springfield; Jack B. Dobler, Alexandria, all of Va.

[73] Assignee: VSE Corporation, Alexandria, Va.

[21] Appl. No.: 505,734

[22] Filed: Jun. 20, 1983

[51] Int. Cl.[3] ..... F25D 17/02

[52] U.S. Cl. ..... 62/177; 62/389

[58] Field of Search ..... 62/389, 394, 98, 177, 62/178, 185, 201; 165/34

[56] References Cited

U.S. PATENT DOCUMENTS

| | | | |
|---|---|---|---|
| 2,511,582 | 6/1950 | Grindrod | 62/98 |
| 2,746,259 | 5/1956 | Katzenberger et al. | 62/389 X |
| 3,552,136 | 1/1971 | Cook | 62/394 X |
| 4,034,571 | 7/1977 | Bollinger | 62/389 X |
| 4,071,078 | 1/1978 | Padden | 62/394 X |

*Primary Examiner*—William E. Tapolcai

*Attorney, Agent, or Firm*—Edmund M. Jaskiewicz

[57] ABSTRACT

The mobile water chiller apparatus of the present invention comprises a refrigeration system, a water system and an engine for driving the water and refrigeration systems. The water system includes a thermostatically controlled blending valve to temper warm water from the water supply with cool water from the evaporator heat exchanger of the refrigeration system so as to provide a constant load to the evaporator heat exchanger inlet and an immediate source of cool water.

8 Claims, 3 Drawing Figures

MOBILE WATER CHILLER APPARATUS

The present invention relates to a portable apparatus for cooling potable water, more particularly, to such an apparatus which draws water from a storage container, reduces the water temperature and delivers the cool water at a preselected temperature to a dispenser.

One of the necessitites of life is that human beings must at all times be provided with water. When persons are engaged in heavy physical activity such as in military operations or construction, water must be supplied to these persons regardless of the environmental conditions in which the persons are operating. When water must be supplied to persons in a hot, arid environment, such as would occur in many deserts or other dry and arid geographical areas, the water supplied to the persons must at least be palatable. In some operations, in hot, arid environments, water is supplied in large storage containers which may be merely positioned upon the ground and in these conditions the containers are subjected to the hot rays of the sun which in turn may warm the water contents of the containers to temperatures of about 120° F. Water of 120° F. is indeed hardly palatable and in fact sometimes cannot be tolerated by the individuals drinking it. It therefore becomes desirable that some measures be taken to lower the temperature of the water before it is drunk.

While refrigeration or other water cooling systems are generally known, such systems are not particularly adaptable for ready and frequent transportation as would be necessary in military operations. Further, not only must a water chilling apparatus be highly mobile, but the apparatus should also be able to provide significant amounts of cooled water at pre-selected temperatures. In view of the flexibility and mobility of such operations, the water chilling apparatus should be light weight and compact but highly efficient so as to be able to provide cool water at locations remote from the reservoir or base water storage areas.

It is therefore the principal object of the present invention to provide a novel and improved hand-transportable water chilling apparatus.

It is another object of the present invention to provide such a mobile water chilling apparatus which delivers cooled water at a pre-selected temperature to a dispenser, storage or transport container.

It is a further object of the present invention to provide such a mobile water chilling apparatus which is compact and light weight, simple in operation and construction but is capable of continuous operation in hot, arid environment to provide a supply of cooled water.

It is an additional object of the present invention to provide such a water chilling apparatus which has a water system capable of dispensing cooled water directly from an evaporator, recirculating the cooled water, or blending cooled water with supplied warm water.

According to one aspect of the present invention, such a mobile water chiller apparatus may comprise a supporting base upon which is mounted a refrigeration system and a water system. The refrigeration system has an evaporator heat exchanger through which heat absorbing fluid is flowed and the water system circulates water through the heat exchanger in which heat in the water is absorbed. A prime mover is also mounted upon the base for driving the water and refrigeration systems. The water system includes a thermostatically controlled blending valve to temper warm water from a supply with cooled water from the heat exhanger evaporator so as to provide a constant load to the inlet of the evaporator heat exchanger.

The mobile water chiller apparatus may also comprise a wheeled trailer upon which is mounted the support base and a water supply container.

Other objects and advantages of the present invention will be apparent on reference to the accompanying description when taken in conjunction with the following drawings, which are exemplary, wherein.

Proceeding next to the drawings, wherein like reference symbols indicate the same parts throughout the various views, a specific embodiment and modifications of the present invention will be described in detail.

Figure 1:
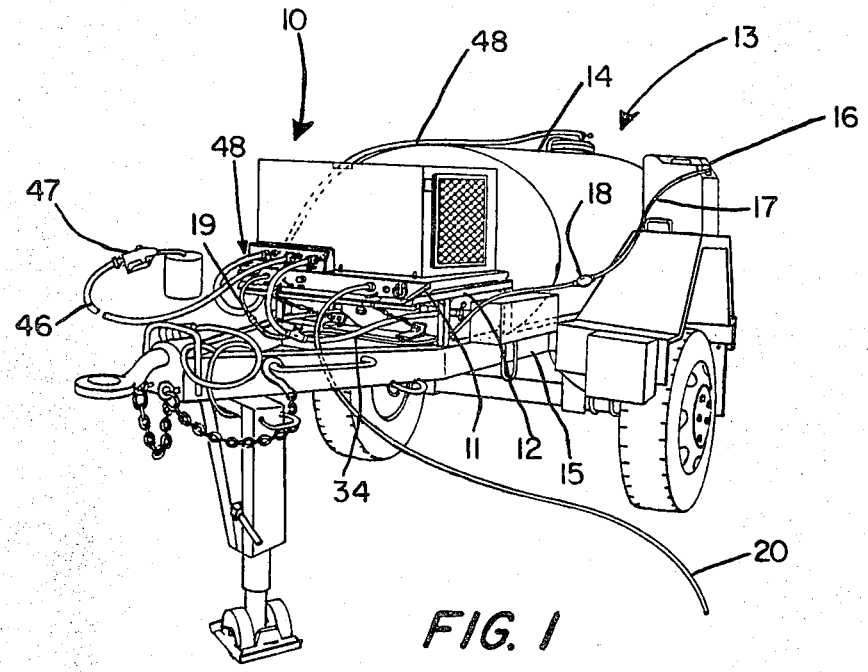
FIG. 1 is an overall perspective view of the mobile water chiller apparatus of the present invention mounted upon a trailer.

As may be seen in FIG. 1, the water chiller apparatus of the present invention is indicated generally at 10 and is mounted upon a skid 11 which in turn is mounted upon a cradle or frame 12 located on the forward portion of a 400 gallon military trailer tank indicated generally at 13. The trailer tank comprises a liquid storage tank 14 mounted upon a chassis or frame 15 in a manner as known in the art. Also mounted on the trailer tank is a fuel supply container 16 connected by a fuel line 17 with an internal combustion engine which is a component of the water chiller apparatus which will be described in detail below. A primer bulb 18 and a fuel filter 19 are provided in the fuel line. 17.

Also extending from the water chiller apparatus is a power line 20 leading to a 12 volt or 24 volt power source as a starter for the internal combustion engine.

Figure 2:
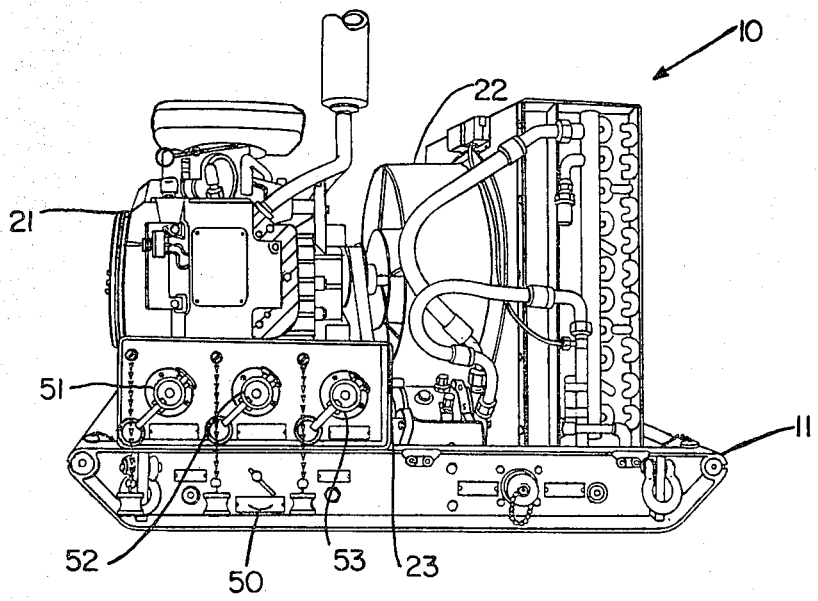
FIG. 2 is a side elevational view of the water chiller apparatus with the cover removed.

The internal combustion engine is illustrated at 21 in FIG. 2 and in this particular embodiment comprises an 18 horse power Briggs and Stratton engine fueled by gasoline. The air-cooled gasoline engine 21 drives a fan in an enclosure 22 and mounted on the engine drive shaft 23. The refrigerant compressor and water circulating pump are driven by the fan hub through timing belts. The engine speed is pre-set and governor controlled.

Figure 3:
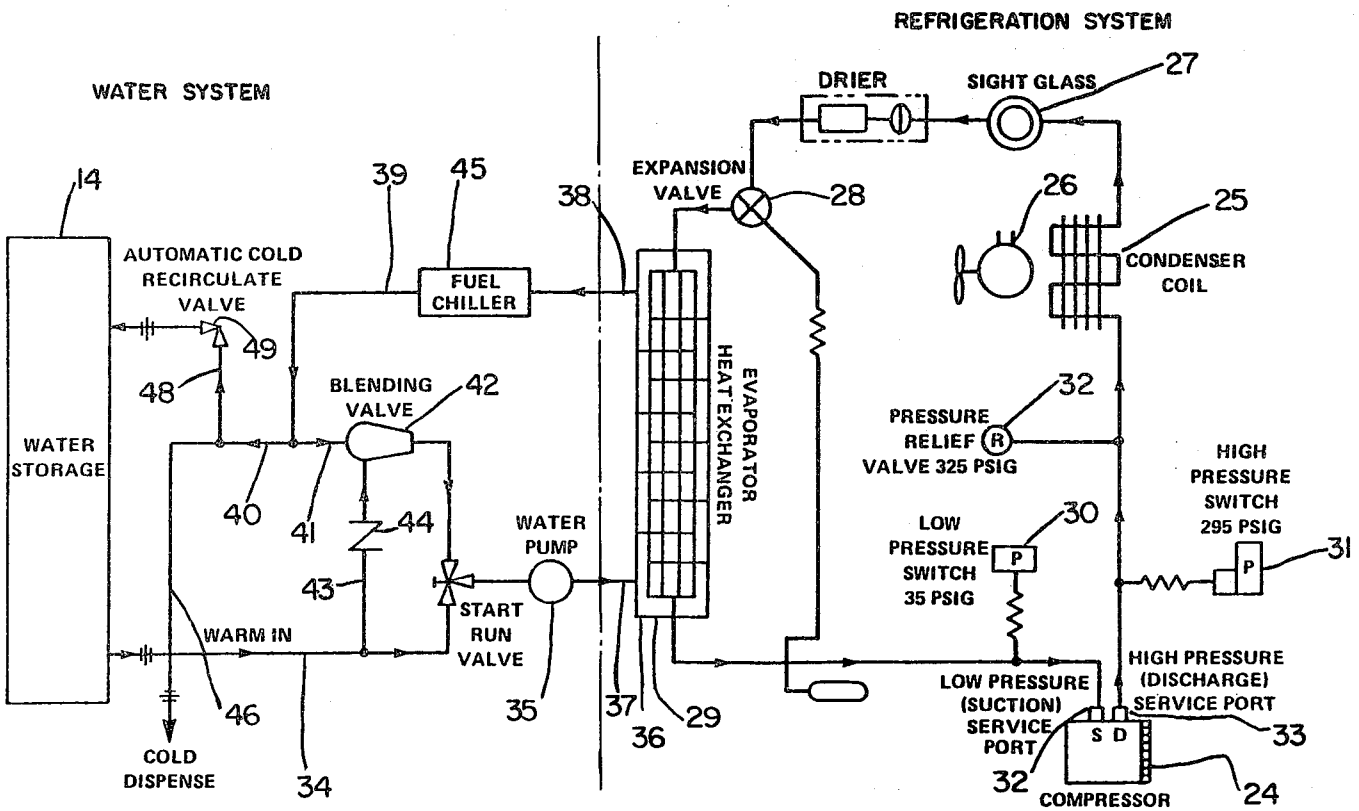
FIG. 3 is a diagram showing schematically the water and refrigeration systems of the present invention.

With reference to FIG. 3, the water chiller apparatus comprises a refrigeration system that circulates the heat-absorbing fluid in the heat exchanger/water chiller and a water system that circulates the water through the heat exchanger/water chiller where the heat in the water is absorbed.

The refrigeration system comprises a compressor 24 that compresses and circulates a suitable refrigerant (R12) through the system. A condensor coil 25 air-cools the compressed gas refrigerant and reduces it to a fluid at high pressure. A fan 26 draws outside air through the condensor coil to dissipate the heat contained in the compressed refrigerant.

There is a sight glass 27 which is an in-line liquid indicator that provides a visual means of determining the condition of refrigerant flowing through the system as follows: a dark green center indicates no moisture in the refrigerant; a light green center indicates an acceptable moisture content in the refrigerent; a yellow center indicates too much moisture in the refrigerant; milky white or bubbly liquid indicates a lower refrigerant charge; clear bubble-free refrigerant indicates a fully-charged system.

An expansion valve 28 controls expansion of liquid refrigerant to gas. A heat exchanger 29 converts liquid refrigerant by expansion into gas which absorbs heat from the water as the water flows through the heat exchanger water jacket.

An automatic control low pressure switch 30 stops the water chiller apparatus when the suction line pressure drops to the minimum pressure allowed. An automatic control high pressure switch 31 stops the water chiller apparatus when the allowable maximum working pressure is exceeded. A low pressure service port 32 and a high pressure service port 33 are provided to serve the high and low side of the refrigerant system. A pressure relief valve **32*a*** vents the refrigerant system to the atmosphere when the maximum allowable pressure is exceeded.

The water system comprises tank 14 which, as a water storage container, is a source of treated potable water and is connected by a flexible hose 34 (as may be seen in FIG. 1) to the water chiller apparatus for cooling. Warm water through the line 34 first flows through a start-run valve which, at the beginning of the chilling operation, enables the water to by-pass a blending valve and to be supplied directly to a water pump 35 which circulates the water through a heat exchanger water jacket 36 which is in heat exchange relationship with the evaporator 29. The water pump 35 also functions to circulate warm water through a blending valve for recirculating as may be required by the thermostatically controlled blending valve.

Water from the pump is supplied to the water jacket through inlet 37 and cool water is exited from outlet 38 into a line 39 which connects to a first branch 40 and to a second branch 41. The second branch 41 connects to the inlet of a blending valve 42 which is thermostatically controlled to control the flow of water for tempering warm water from the storage container with cooled water from the evaporator to provide a constant load to the evaporator heat exchanger inlet 37.

There is a line 43 connecting warm water supply line 34, through a check valve 44 to the blending valve 42 for supplying warm water to the blending valve.

In the discharge line 38 there may be provided a fuel chiller 45 which functions as a heat exchanger to lower the temperature of the gasoline or other fuel before it is supplied to the engine powering the water chiller apparatus. Since the apparatus is intended for use at ambient temperatures of 120° F. it is desirable under such conditions to lower the temperature of the fuel before it is supplied to the engine.

The first branch 40 is connected directly to a flexible hose 46 having a dispenser 47 on the end thereof for dispensing cool water directly from the heat exchanger.

Also connected to branch 40 is a line 48 which connects back to the water storage tank 14. The line 48 is provided with an automatic cool recirculate valve 49 to provide for recirculation of the chilled water when it is not being dispensed.

The water chiller apparatus as disclosed herein is capable of cooling intake water at 120° F. to 60° ±10° F. at a delivery rate of approximately 40 gallons per hour.

All engine controls are accessible from an access door provided at the left end of a cover provided to enclose the apparatus. All hose connections are accessible from the side of the apparatus as seen in FIG. 2. The start-run water control 50 is located at the front bottom of the chiller apparatus as may be seen in FIG. 2.

The engine may be started with either a rope starter, a 12 or 24 VDC self-starter as known in the art.

The hose connections are of the quick, detachable type and comprise cool circulate connection 51, cool dispense connection 52, and the warm water connection 53.

The flexibility of the water chiller apparatus according to the present invention is readily apparent when it is considered that the water chiller apparatus delivers cooled water for immediate use or recirculates the cooled water to the supply source for gradual cool down until the supply source reaches the desired low temperature when automatic shut-down is effected by a low temperature switch (not shown).

Thus, it can be seen that the present invention has provided a skid-mounted, hand-transportable, air-cooled, gasoline-driven, water chiller apparatus capable of continuous operation in a hot/arid environment having an ambient temperature of 120° F. The water chiller apparatus draws water from the storage tank, reduces the water temperature and delivers the cooled water at a pre-selected temperature to a dispenser or storage container.

It will be understood that this invention is susceptible to modification in order to adapt it to different usages and conditions, and accordingly, it is desired to comprehend such modification within this invention as may fall within the scope of the appended claims.

What is claimed is:

1. A mobile water chiller apparatus comprising a supporting base, a refrigeration system on said base to circulate a heat absorbing fluid and having an evaporator heat exchanger through which said fluid is flowed, a water system on said base circulating water to a water inlet and a water outlet of said evaporator heat exchanger in which heat in the water is transferred, means on said base for driving said water and refrigeration systems, said water system including a thermostatically-controlled blending valve connected between said water outlet and said water inlet and to a supply of water to be chilled so as to temper warm water from a supply with cool water from the evaporator heat exchanger outlet whereby a constant load is provided to the evaporator heat exchanger inlet.

2. A mobile water chiller apparatus as claimed in claim 1 wherein said water system further comprises a recirculate valve connected to said water outlet to recirculate cooled water from said evaporator heat exchanger to a said water supply.

3. A mobile water chiller apparatus as claimed in claim 1 and further comprising means connected to said water outlet for dispensing cool water exiting from said water outlet.

4. A mobile water chiller apparatus as claimed in claim 1 and further comprising a water discharge line connected to said water outlet of said evaporator heat exchanger and to first and second branches, said first branch connected to said water supply and said second branch connected to said blending valve.

5. A mobile water chiller apparatus as claimed in claim 4 and further comprising means connected to said first branch line for dispensing cold water from said evaporator heat exchanger, a third branch connected between said first branch and said water supply, and a recirculate valve in said third branch line.

6. A mobile water chiller apparatus as claimed in claim 1 and further comprising a wheeled trailer, said support base and a said water supply mounted on said trailer.

7. A mobile water chiller apparatus as claimed in claim 1 wherein said driving means comprises an internal combustion engine drivingly connected to said water and refrigeration systems.

8. A mobile water chiller apparatus as claimed in claim 4 and further comprising means connected between the water outlet of said evaporator heat exchanger and said blending valve for cooling fuel to be supplied to said engine.

* * * * *